US007327322B2

(12) United States Patent
Capps et al.

(10) Patent No.: US 7,327,322 B2
(45) Date of Patent: Feb. 5, 2008

(54) DIRECTIONAL ANTENNA HAVING A SELECTED BEAM PATTERN

(75) Inventors: Charles P. Capps, Carmel, IN (US); James L. Kohler, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 268 days.

(21) Appl. No.: 11/158,749

(22) Filed: Jun. 22, 2005

(65) Prior Publication Data

US 2007/0008234 A1 Jan. 11, 2007

(51) Int. Cl.
*H01Q 1/32* (2006.01)

(52) U.S. Cl. ..... 343/713; 343/711

(58) Field of Classification Search ..... 343/721, 343/711, 713, 712; 398/115
See application file for complete search history.

(56) References Cited

U.S. PATENT DOCUMENTS

| | | | | |
|---|---|---|---|---|
| 2,423,648 A | | 8/1947 | Hansell | |
| 3,683,379 A | * | 8/1972 | Saddler et al. | 342/71 |
| 3,794,997 A | * | 2/1974 | Iwatsuki et al. | 342/72 |
| 5,313,213 A | * | 5/1994 | Neumann et al. | 342/165 |
| 5,446,470 A | | 8/1995 | Avignon et al. | |
| 5,963,172 A | * | 10/1999 | Pfizenmaier et al. | 343/721 |

FOREIGN PATENT DOCUMENTS

| | | |
|---|---|---|
| EP | 1657787 | 5/2006 |
| FR | 2703517 | 10/1994 |

OTHER PUBLICATIONS

EP Search Report Dated Sep. 21, 2006.

* cited by examiner

*Primary Examiner*—Hoanganh Le
(74) *Attorney, Agent, or Firm*—Jimmy L. Funke

(57) ABSTRACT

A directional antenna is provided that utilizes an existing light source or simple reflector having a beam directing reflective surface and a transparent cover for transmitting and receiving electromagnetic radio waves. In an aspect, an information signal is impressed across a conductive material formed to a transparent cover and the reflective surface directs electromagnetic radio waves in a predetermined direction. Beam pattern, gain, polarization and wavelength can be selected through the design and positioning of the conductive material from the reflective surface for providing an effective resonant antenna. The radiated information signal may be used to detect an object or communicate with a receiver. The light source or reflector can be attached to a fixed structure or to a mobile vehicle. In the case of a mobile vehicle, the antenna is fully concealed. In an aspect, material costs, manufacturing costs and assembly costs are reduced as compared to presently available antennas.

25 Claims, 7 Drawing Sheets

DIRECTIONAL ANTENNA HAVING A SELECTED BEAM PATTERN

FIELD OF THE INVENTION

The invention relates generally to wireless communications, and more particularly to utilizing a light source or a simple reflector having a reflective surface and transparent cover to deliver a selected beam pattern for use as a directional antenna.

BACKGROUND OF THE INVENTION

In the past, telecommunication services integrated in an automobile were limited to a few systems, mainly analog radio reception (AM/FM bands), for which a simple whip antenna was mounted to and extended from a vehicle body. A disadvantage of this fixed mast monopole antenna is that it protrudes from the exterior of the vehicle as an unsightly vertical wire with a height of roughly one quarter wavelength of the signal frequency. This is because the whip antenna must exhibit certain mechanical characteristics to achieve user needs and meet required electrical performance. The antenna length, or the length of each element of an antenna array, depends on the received and transmitted signal frequencies. A further disadvantage of the monopole antenna is that it is susceptible to damage due to vandalism and car wash systems.

Further, the monopole antenna has a nearly omnidirectional radiation pattern, which provides a signal sent with approximately the same strength in all directions in a generally horizontal plane, producing a null only towards the sky. Another disadvantage of the monopole antenna is that it is typically narrowband with a bandwidth of roughly ten percent. With the rising number of communication systems, there are a continuously rising number of services that are to be integrated in the vehicle and which require further antennas to be arranged in the vehicle. Further, if antenna diversity is used to provide directional sensitivity, a number of antennas are required. However, since vehicle design is often dictated by styling, the presence of numerous protruding antennas is not desirable.

In an effort to minimize any aesthetically displeasing appearance or visually obstructive antenna characteristics, a trend emerged to embed the antenna system into the vehicle structure, such as, for example, into a rear window. Further, an integration of several telecommunication services into a single antenna is attractive to reduce manufacturing and installation costs of multiple antennas. However, rear window antennas exhibit troubles, for example, pattern disconnection of the thin window antenna often occur.

Not only are the electrical, mechanical and aesthetic properties of an antenna important, but an antenna must also overcome unique performance issues in the wireless environment. Further, antenna integration is becoming more necessary due to a cultural change towards an information society. The Internet has evoked an information age in which people around the globe expect, demand, and receive information. Car drivers expect to be able to drive safely while handling e-mail and telephone calls and obtaining directions, schedules, and other information accessible on the World Wide Web. Telematic devices can be used to automatically notify authorities of an accident and guide rescuers to the car, track stolen vehicles, provide navigation assistance to drivers, call emergency roadside assistance, and provide remote engine diagnostics. In designing the antenna, careful consideration must be given to the antenna electrical characteristics so that signals transmitted from and received by a communications device satisfies pre-determined operational limits, such as the bit error rate, signal-to-noise ratio or signal-to-noise-plus-interference ratio. In a number of applications, an omnidirectional antenna is less effective in achieving optimum values for these characteristics, as compared with a directional antenna.

The directional antenna, provides a concentrated signal or beam in a selected direction. Concentrating the beam increases the antenna gain and directivity. Directional antennas are often utilized to communicate with terrestrial support, with short range communication systems (SRC). Radio frequency (RF) communication signals are typically employed for their advantages of penetrating and passing through objects, their low power, and low cost.

However, directional antennas currently suffer from disadvantages of having complex shapes and large size, making them difficult to package in a vehicle. It is preferable to conceal the antenna to protect it from the environment and to preserve vehicle aesthetics. In order to conceal the antenna, it is usually necessary to locate the antenna beneath the sheet metal body of a vehicle. However, the sheet metal shields and adversely affects the performance of the directional antenna.

A novel directional antenna is described by U.S. patent application Ser. No. 11/987,786, entitled Directional Antenna, assigned to Delphi. In one description, the antenna includes an information signal impressed across a light filament of a vehicle headlight, and a reflective surface directs the electromagnetic radio waves in a predetermined direction. The antenna is fully concealed and can operate using an unmodified, factory installed vehicle headlight. However, the beam pattern is set in part by the physical characteristics and positioning of the filament and the reflective surface.

SUMMARY OF THE INVENTION

A directional antenna is provided that utilizes an existing light source having a beam directing reflective surface and a transparent cover for transmitting and receiving electromagnetic radio waves. Beam pattern, gain, polarization and wavelength can be selected for providing an effective resonant antenna. In view of the fact that lights having reflective surfaces are utilized in a wide variety of environments, it is to be appreciated that the present invention has numerous applications, including being employed with lights situated to a fixed structure such as to a building or post, as well as with lights attached to a mobile vehicle such as front headlights and rear lights. Simple reflectors without a light filament can additionally be utilized with the present invention.

In an embodiment, the directional antenna of the present invention reduces material costs, manufacturing costs and assembly costs, as compared to presently available antennas. The antenna system can be readily installed into a vehicle with minor additions or modifications, may be operated with minimal or no impact on the performance of an existing headlight, and can be fully concealed. Further, superior directivity of transmitting broadcasting signals is obtained at particular frequencies, as well as a reduction in power usage.

In an embodiment, the present invention can be used for vehicle-to-base or vehicle-to-vehicle communication systems. The present invention can be used for short range communication systems for a motor vehicle including electronic toll collection (ETC) systems. The present invention may further be useful for inter-roadway communication systems. The present invention can be used for long range communication systems. The present invention can further be useful for vehicle entry and exit monitoring systems, security and warning systems, adaptive cruise control, guidance applications, such as for controlling vehicles from drifting from their traffic lane. Additionally, the present invention may be used to detect objects, such as obstructions and other vehicles, distant from a vehicle in the forward direction. The present invention can be used for a forewarn ACC system or backup aid systems as well.

Features of the invention are achieved in part by making use of an existing reflective surface and transparent cover, such as in a vehicle headlight or simple reflector. In an embodiment, the radiating or receiving antenna element (a conductive material) is formed to the transparent cover of a vehicle headlight. Together, the conductive material and the light beam reflector direct an RF transmission toward an intended receiver, or receive an RF transmission from an intended receiver.

In an embodiment, a processor is connected to an AC source and an oscillator, the oscillator for generating a carrier frequency. A modulator thereafter superimposes the AC source onto the carrier frequency for transmission via a transmission link to the conductive material. A magnetic field is created about the conductive material, which radiates electromagnetic radio waves. The reflective surface directs the electromagnetic radio waves in a predetermined direction, maximizing antenna performance. In an embodiment, the conductive material is incorporated into a vehicle headlight. The antenna system may be incorporated with a fixed structure or with a mobile vehicle including a car, truck, airplane, ship, boat, etc.

Beam pattern, gain, polarization and wavelength can be selected through the design of the conductive material. The conductive material can be formed in an elected pattern, length and size, and can further be positioned a selected distance from the reflective surface. The distance that the conductive material is positioned with respect to the reflective surface can be selected by modifying the shape or depth of the transparent cover, since the conductive material is formed to the transparent cover.

In an embodiment the present invention generates an RF signal having a bandwidth at a frequency in the range of about 1 megahertz (MHz) to at least 100 gigahertz (GHz) for broadcasting to a receiver or for detecting objects. Experimental results have shown to date that the more useful transmitter frequencies, having acceptable gain and reaching a resonant frequency, are in the range of 80 MHz to 600 MHz for a standard motor vehicle headlight. It is to be appreciated that other standard motor vehicle headlights may vary in useful transmitter frequencies.

Other features and advantages of this invention will be apparent to a person of skill in the art who studies the invention disclosure. Therefore, the scope of the invention will be better understood by reference to an example of an embodiment, given with respect to the following figures.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE INVENTION

Figure 1:
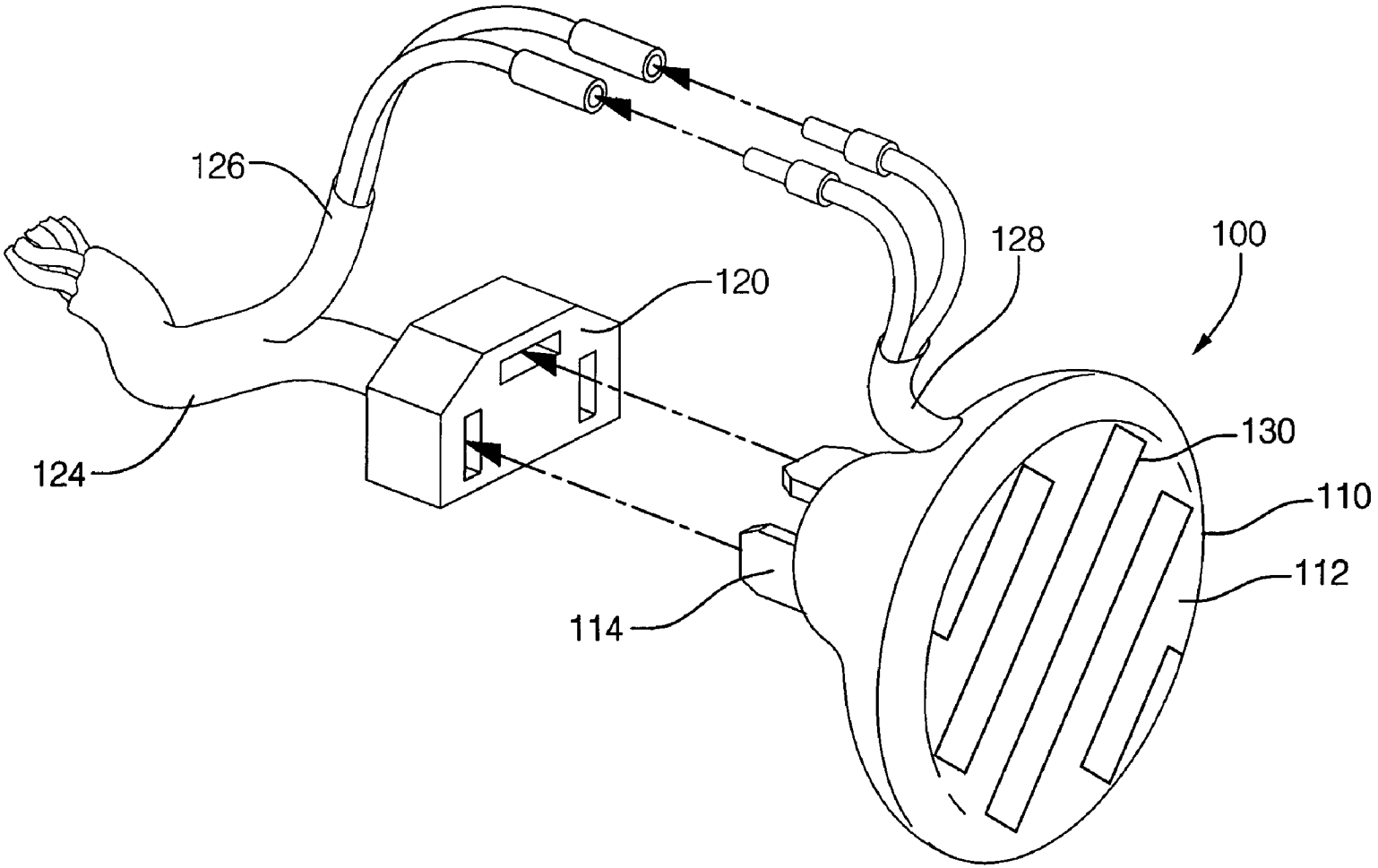
FIG. 1 is a perspective view of a conventional light and power connection as used in a motor vehicle, having an added transmission link and conductive material formed to a transparent cover, in accordance with an embodiment of the present invention.

Exemplary embodiments are described with reference to specific configurations. Those of ordinary skill in the art will appreciate that various changes and modifications can be made while remaining within the scope of the appended claims. Additionally, well-known elements, devices, components, methods, process steps and the like may not be set forth in detail in order to avoid obscuring the invention. Further, unless indicated to the contrary, the numerical values set forth in the following specification and claims are approximations that may vary depending upon the desired antenna characteristics sought to be obtained by the present invention.

A system and method is described herein for providing a directional antenna. An existing light source or simple reflector having a beam directing reflective surface and a transparent cover is utilized for transmitting and receiving electromagnetic radio waves. Beam pattern, gain, polarization and wavelength can be selected for providing an effective resonant antenna. It is to be appreciated that features of the discussion and claims can be utilized with a simple light or reflector, which can be situated to a fixed structure such as to a building or post, as well as with lights or reflectors attached to a mobile vehicle including a car, truck, bicycle, airplane, ship, and boat. The present invention may be used to detect an object or communicate with a receiver/transmitter. In an embodiment, the present invention is employed for communication services of a motor vehicle.

In an embodiment, the directional antenna provided by the present invention is readily installed into a vehicle with a minor addition or modification. Material costs, manufacturing costs and assembly costs are reduced as compared with existing antennas. Further, an important advantage of the present invention is that the antenna system provided can be utilized with an assortment of vehicles, lights and reflectors having distinct designs and manufacturers. Further, in an embodiment the present invention may be operated with little to no impact on the performance of the existing headlight, for example headlight luminosity or light beam direction. The present invention also eliminates mounting operations in production lines. The perforation of the car bodywork is also avoided, ensuring a solid and watertight fixture. In contrast, conventional whip antennas often perforate the car bodywork and are exposed to high air pressure. Additionally, the present invention cannot easily become disconnected (i.e., upon exterior vehicle cleaning). Moreover, the directional antenna provided is concealed and makes a virtually imperceptible visual impact on the car design. Also, a driver's visibility (field of view) is not obstructed by the antenna system provided.

Additionally, a reduction in power is realized since the antenna beam patterns extend outward in the direction of a receiver and are attenuated in other directions. Superior directivity of transmitting broadcasting signals is also obtained. Further, by directing transmissions toward a receiver, and directively receiving signals, the antenna system of the present invention reduces effects of multipath fading. Further, the present invention obviates the problem of radiation leakage into the interior of a vehicle. Moreover, aerodynamic properties, a concern in regard to vehicle fuel consumption and vehicle noise, are unaffected.

Referring to the drawings wherein identical reference numerals denote the same elements throughout the various views, FIG. 1 illustrates a conventional light and power connection as used in a motor vehicle, having an added transmission link and conductive material formed to a transparent cover. Headlight 100 includes a reflective surface 110, transparent cover 112, male power connector 114, female power connector 120 and power cable 124. Headlight 100 reflects light by use of reflective surface 110 formed in a parabolic shape, effecting a directive beam pattern. Typically, a direct current (DC) source such as a battery supplies operational power to a filament (filament not shown) via power cable 124. Power cable 124, conventionally a coaxial cable, provides power to, and is affixed to, female power connector 120. Male power connector 114 connects to female power connector 120, transferring power to a filament. Additionally, conductive material 130 is formed to transparent cover 112, as further discussed below.

In an embodiment, the present invention applies an information signal to transmission cable 126 passing to transmission cable 128, which can be in the form of an alternating current (AC). Transmission cable 126 and transmission cable 128 can be a conventional coaxial cable. Other transmission lines can be utilized such as parallel-wire or waveguides for transmission of microwaves. As shown, transmission cable 126 can be attached to conventional power cable 124. Transmission cable 128 is formed to headlight 100 and connects to conductive material 130. Optionally, transmission cable 126 and transmission cable 128 are separate and connectable cables to allow simple replacement of headlight 100 for any reason (i.e., damaged headlight, worn filament, etc.). This way, an AC information signal generator, providing a signal to transmission cable 128 is unaffected by such a replacement.

Figure 2:
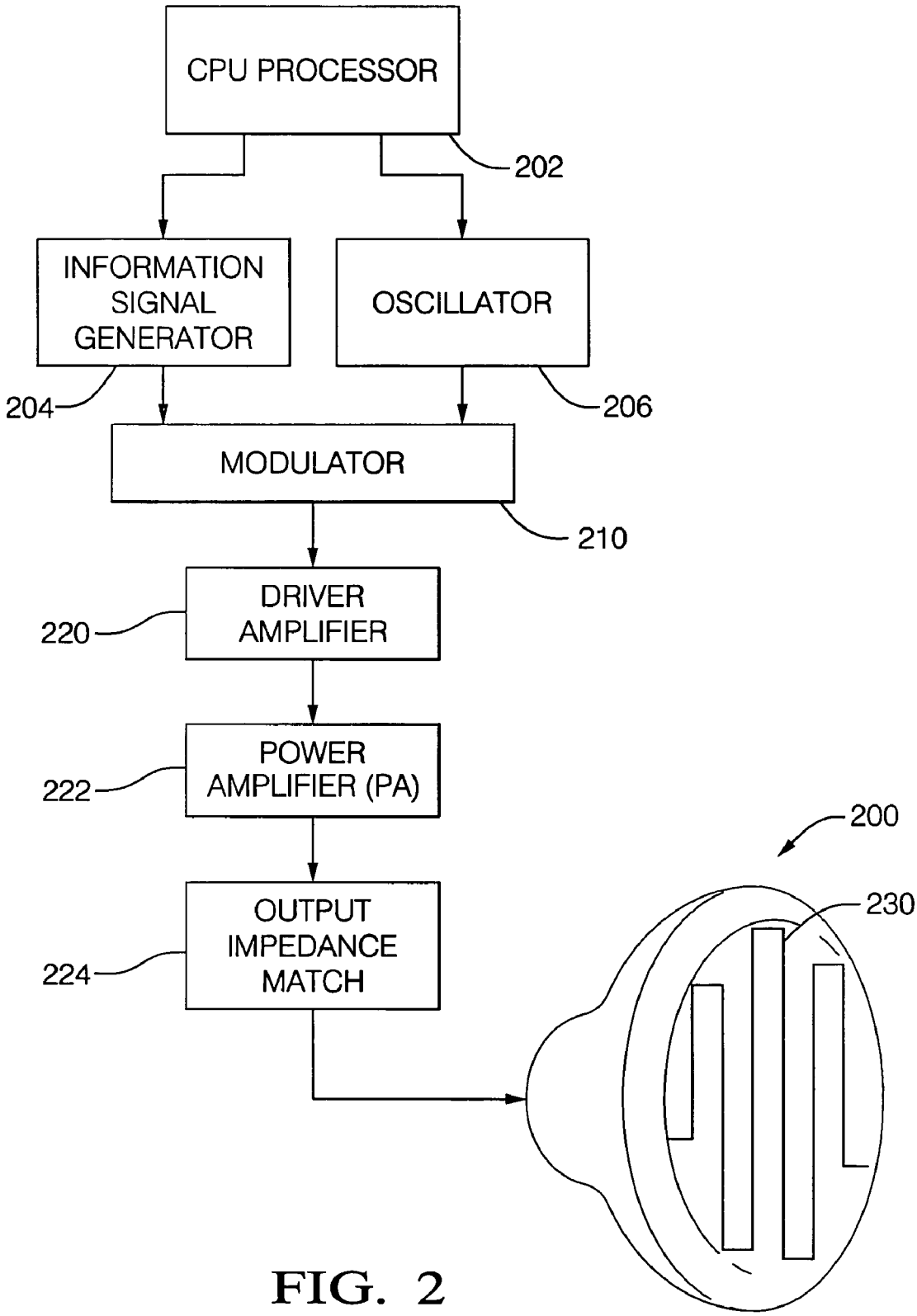
FIG. 2 is a diagrammatic sectional view illustrating the general components of an embodiment of the present invention.

FIG. 2 is a diagrammatic sectional view illustrating the general components of an embodiment of the present invention. A processor 202 instructs information signal generator 204 to generate a desired information signal and feed it to modulator 210. In communications technology, it is important to maximize antenna performance, including characteristics such as antenna gain, bandwidth, directivity and efficiency, and processor 202 is employed in part for that purpose. Frequency or signal interference may occur during transmission due to various conditions including weather, changes in terrain and other physical obstructions. To maintain signal and system integrity in the face of increasing error rates, a system operator or processor 202 can decrease the maximum data rate. Processor 202 also instructs oscillator 206 to generate a wave at the carrier frequency without harmonics or other spurious signal content. Oscillator 206 can generate either a fixed frequency or a variable frequency. Modulator 210 superimposes the information signal onto the carrier frequency. Driver amplifier 220 raises the signal power level to drive the final amplifier. There may be one or more driver stages depending upon the power needed to be delivered to the power amplifier (PA) 222. Driver amplifier 220 can also provide buffering and filtering operations. Power amplifier 222 delivers the required power to the transmitting headlight antenna 200. A signal generator, oscillator, modulator, driver amplifier and power amplifier electronics module are well known to one of ordinary skill in the art and, hence, will not be discussed in detail. Output impedance match 224 is provided to match the antenna impedance, transmission line impedance and transmitter impedance, and maximize power transfer from the antenna to a receiver. Once the AC information signal reaches headlight antenna 200, a magnetic field is produced about conductive material 230 and electromagnetic waves are directed to a distant receiver. The electromagnetic waves are directed to a receiver as discussed in FIG. 6 below.

Figure 3:
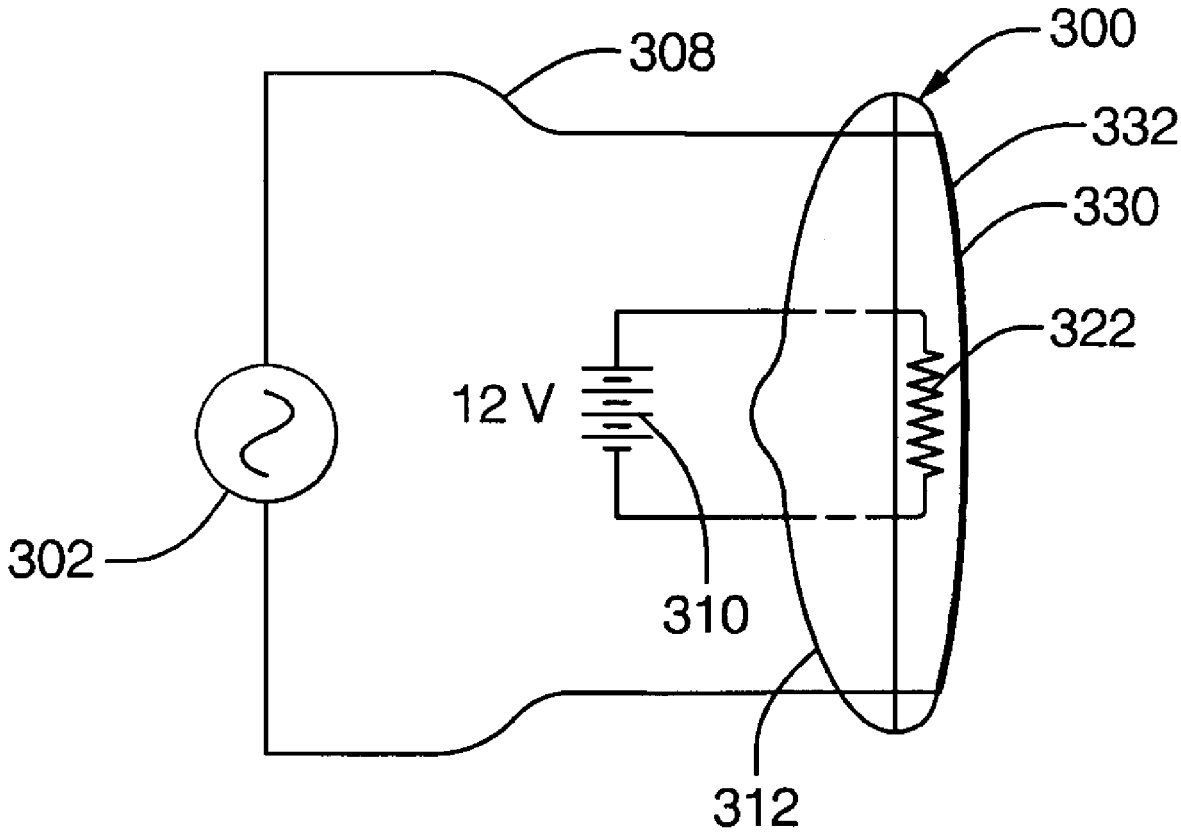
FIG. 3 is a schematic view of the light as in FIG. 1 incorporating an embodiment of the present invention.
Figure 4A:
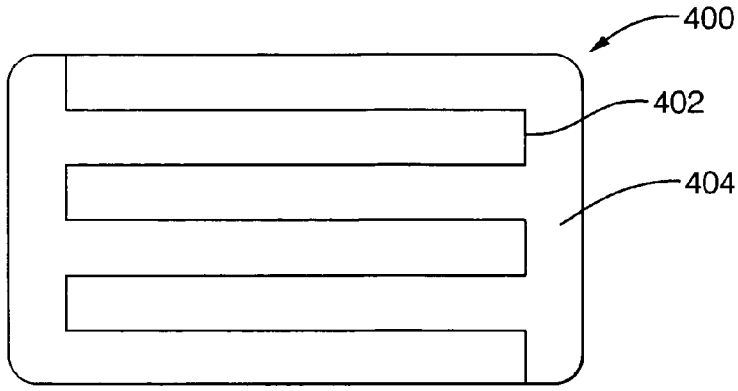
FIG. 4 illustrates various conductive material shapes for the conductive material as in FIG. 1, in accordance with an embodiment of the present invention.
Figure 4B:
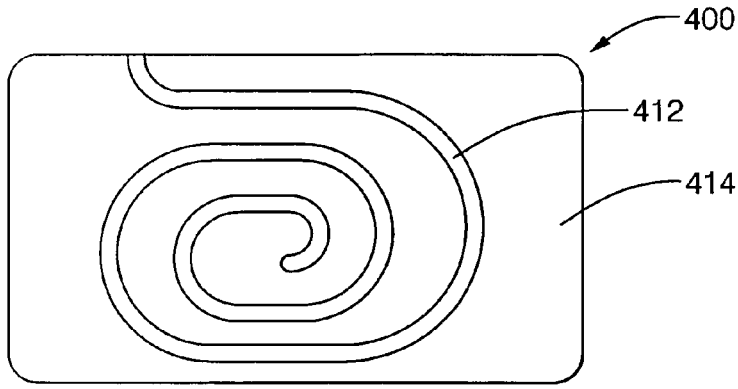
Figure 4C:
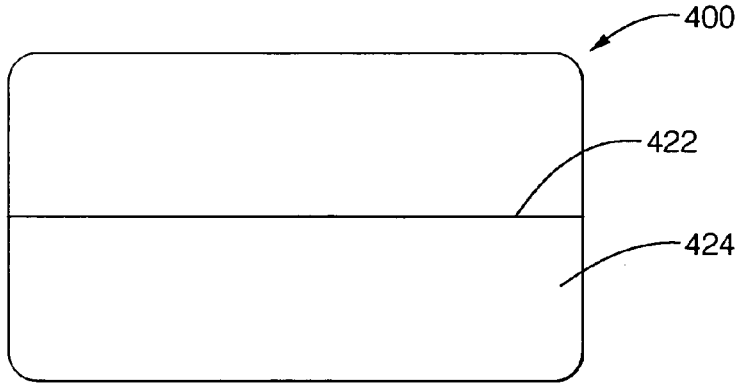
Figure 4D:
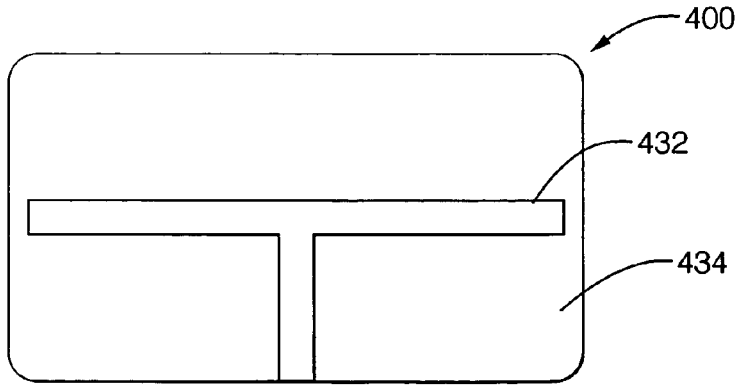

Referring to FIG. 3, a schematic view of the light 300, including a reflective surface 312, and a transparent surface 332 having a conductive material 330 formed thereto, as in FIG. 1. AC signal generator 302 is connected in electrical series with conductive material 330. The information signal generated from AC signal generator 302 is supplied to conductive material 330 via transmission cable 308. Additionally, a DC voltage 310 can be fed to filament 322. Any noise can be minimized by system processing, for example in the case of a halogen headlight lamp. As can be observed, the present invention provides a design having minimal modification impact on a light or reflector. Further, all components are protected in an enclosed site, eliminating environmental impact such as weather concerns or vehicle cleaning concerns.

FIGS. 4A-4D illustrate various shapes, lengths and orientation options of the conductive material formed to a transparent cover, part of a headlight or simple reflector. The conductive material is formed in a shape and length that is dependent on the required polarization for the transmitted signal. For communication systems, numerous polarization directions exist, and so systems must be made sensitive to many possibilities. As shown, alternative shapes include conductive material 402, a shape that alternates back and forth, formed to transparent material 404. Conductive material 412, a spiral shape, formed to transparent material 414 can also be employed. Conductive material 422, a substantially straight shape, formed to transparent material 424 can additionally be employed. Conductive material 432, a T-shape, formed to transparent material 434 can further be employed. Countless additional shapes can be employed including rectangular shapes or a combination of shapes. Further, the conductive material can be formed in a selected length.

Conductive material can be formed to the inside of a transparent cover, the outside of a transparent cover or formed within the material of a transparent cover. By forming the conductive material to the inside of a transparent cover or within the material of a transparent cover, outside environmental concerns are avoided, such as weather and cleaning concerns. Alternatively, the conductive material can be applied to the outside of a transparent cover to avoid dismantling a headlight. Further, the conductive material can be formed to a transparent cover by an adhesive including tape, or alternatively by painting the conductive material to the transparent material. The paint can act as a binder and adhesive. In an embodiment, the conductive material is formed to a transparent cover in thin strips with a minimized amount of conductive material to minimize any reduction of the light caused by the conductive material and emitted from the filament through the transparent cover. Various materials can be utilized as conductive material 432, including copper, silver, gold, aluminum, indium tin oxide, or a blend of metals. Further, conductive material 432 can be formed of a transparent material, i.e., indium tin oxide, to enhance aesthetics and maintain full performance of an existing light.

Figure 5:
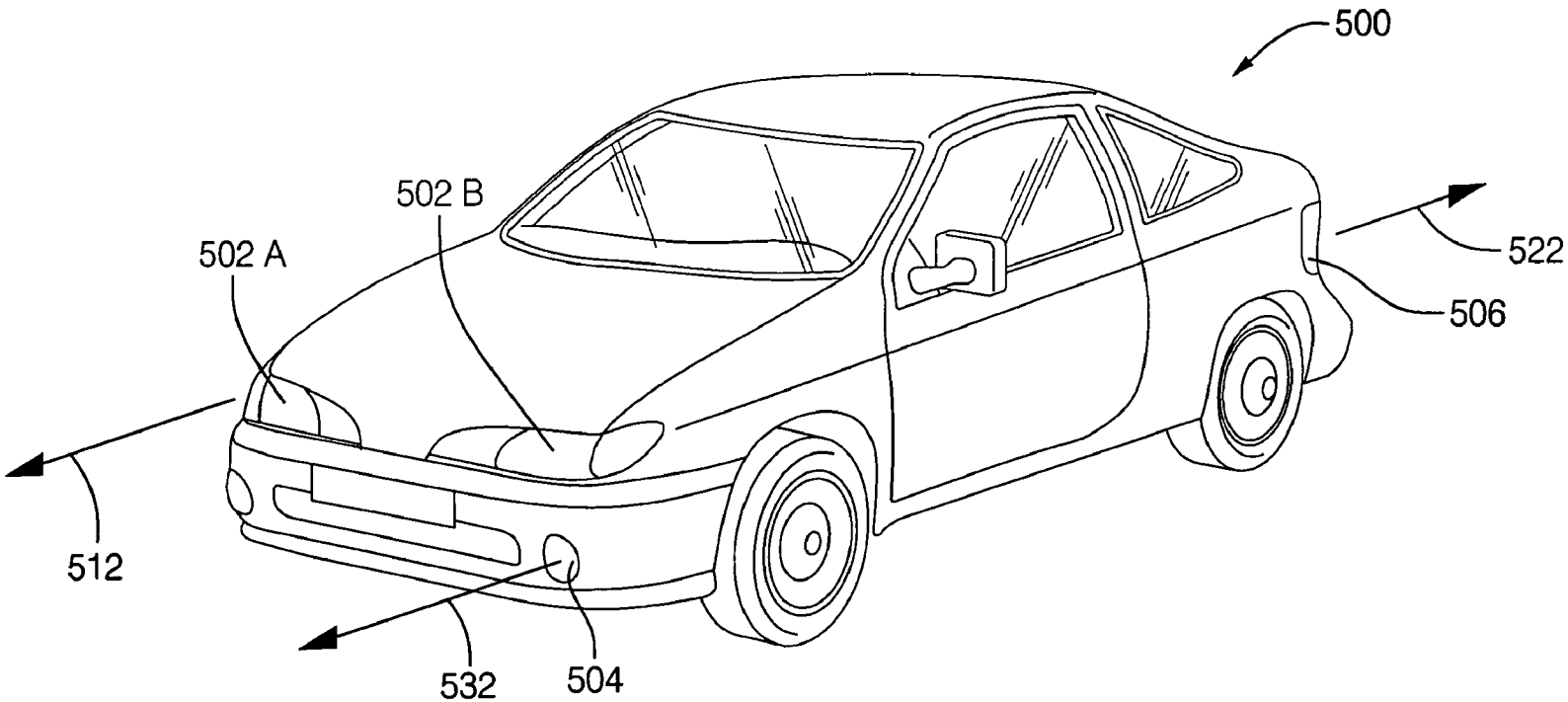
FIG. 5 is a perspective view of an automobile showing motor vehicle lights that can act as a directive antenna, in which the present invention is useful, in accordance with an embodiment of the present invention.

As illustrated in FIG. 5, a choice of motor vehicle lights and motor vehicle reflectors can act as a directive antenna, including headlights 502A and 502B, fog lights 504, and brake lights 506. Lights and simple reflectors without a filament that are mounted to a motor vehicle at other positions may similarly be utilized by an embodiment of the present invention. With the numerous light and reflector options, signals can be transmitted or received at numerous positions on a motor vehicle. For example, headlights 502A and 502B can transmit a signal in direction 512, fog lights 504 can transmit a signal in direction 532, and brake lights 506 can transmit a signal in direction 522. In an embodiment, a single headlight is employed for signal transmissions from motor vehicle 500. In another embodiment, additional headlights (two or more) are employed and processor 202 (FIG. 2) selects among the headlight antennas having various radiation patterns to maximize the received signal to noise, or signal to interference ratio.

In a further embodiment, a phased array pattern is employed utilizing at least two vehicle headlights. It is to be appreciated that vehicle headlights are spaced with maximized distance, making the headlights a useful component for spacing needs of a phased array antenna system. In a phased array operation, the current magnitude and phase of each vehicle headlight is adjusted to reinforce the radiation pattern in a desired direction and suppress the radiation pattern in undesired directions. Vehicle headlights 502A and 502B, being spaced apart on a vehicle, maximize the distance between radiating antennas, in a phased array embodiment of the present invention. Hence, the relation between the direction and intensity of RF beam radiation of the antennas (directivity) can be improved by utilizing two vehicle headlights or a dual element antenna. Further, in regard to directional pattern or directivity, by utilizing two headlights set apart, the widths of the RF beams can be narrowed, and the directional resolution can be improved. In an embodiment, beamwidths are varied, for example to create a null to minimize interference between signal transmission and signal reception.

Figure 6:
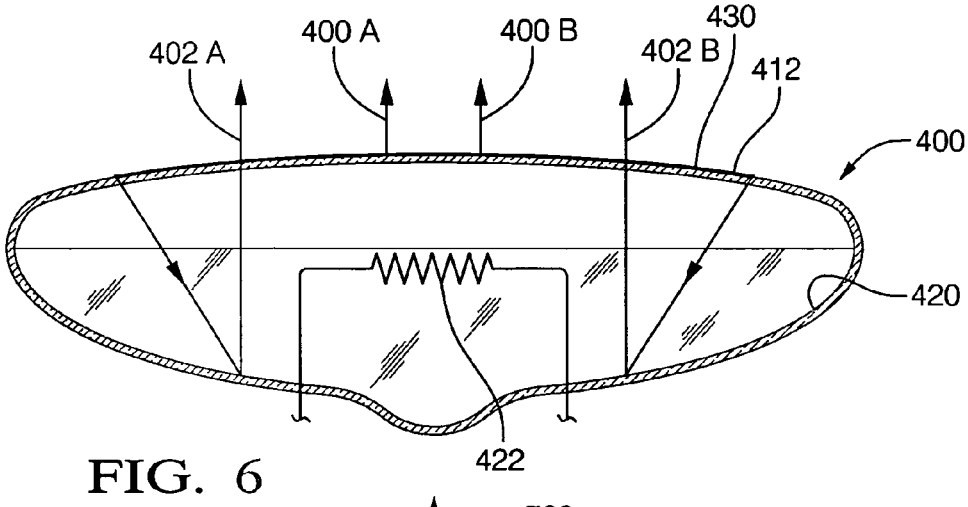
FIG. 6 illustrates a schematic view of directional beams transmitted from a conductive material and reflective surface, in accordance with an embodiment of the present invention.

FIG. 6 shows a schematic view of directional beams (modulated informational signal) transmitted from conductive material 430 and reflective surface 420, in an embodiment of the present invention. Headlight 400, having physical attributes for illumination use with a motor vehicle, is the type of headlight coming factory installed into a vehicle. The attributes of headlight 400 include a parabolic reflective surface 420 that emits light beams in a predetermined direction and distance. Conductive material 430 causes electromagnetic waves 400A and 400B, and reflected electromagnetic wave 402A and 402B to be emitted from headlight 400.

It is to be appreciated that modifications can be made to the physical attributes of reflective surface 420, to transparent cover 412 and to conductive material 430 to change the directive beam pattern from the antenna array. By conductive material design freedom, the antenna length and distance from a reflective surface, and therefore gain, matching and wavelength can be adjusted. Also, improved beam pattern can be obtained. Variable beamwidth and beam steering is possible across the frequency range. The required resonance is selected to give the preferred reflection from the transparent cover and from the reflective surface.

Modifications can include changing the conductive material 430 size, length or shape, changing conductive material 430 spatial positioning in relation to reflective surface 420, and changing the curvature or shape of reflective surface 420. In the case wherein the length of conductive material 430 is decreased, the resonant frequency of the system is increased, since conductive material 430 length is inversely proportional to system resonant frequency. Causing an increase in resonant frequency may prove useful in certain broadcasting applications. Additionally, reflective surface 420 can be formed in the shape of a parabola and direct electromagnetic waves as a parabolic antenna. Other shapes can also be used for reflective surface 420 including a hyperboloidal surface, ellipsoidal surface, etc.

In an embodiment, the transparent cover 412 is modified from a standard manufactured version, wherein the modification includes one of a modified transparent cover shape and a modified transparent cover spatial positioning relative to the reflective surface 420. In another embodiment, a secondary transparent extension cover or extension is formed over the standard transparent cover 412. The conductive material 430 is formed on the secondary transparent extension cover. Further, it is to be appreciated that the conductive material 430 may be formed to both a standard transparent cover 412 and to an attachment transparent cover. This way, the processor can manage a transmission to an alternative conductive material to optionally vary the reflective properties of the signal. This addition can be utilized for raising the vertical pitch of a directional beam. This is useful to accommodate for signal interference due to an obstruction, or to accommodate for changes in orientation of the transmitter vehicle 500 relative to a receiver.

The system described follows established resonant frequency principles. In an embodiment, the transmitter is a variable frequency AC source. The variable frequency AC is applied to a series circuit containing some value of inductance and capacitance, which pose some value of reactance. As the frequency of the variable AC source is adjusted throughout its entire range, a specific frequency is reached causing the inductive reactance to equal the capacitive reactance. At this point in the frequency spectrum, the circuit current is the highest, capacitive reactance is equal to the inductive reactance, and resonant frequency is reached. As well known in the art, $f_r=1/(2\pi\sqrt{(LC)})$, where $f_r$ is the resonant frequency, L is the inductance value and C is the capacitance value.

The range of the system transmission is dependant on the resonance selected and the selected power, which can be managed by the processor for the particular purpose of the transmission. In an embodiment, a transmission link is provided between a control means (not shown) and headlight antenna 200 (FIG. 2). Via the transmission link, the output of the antenna is transmitted to the control means, and power for operating a level adjusting means is transmitted from the control means to headlight antenna 200. For an extended transmission range, the headlight can be appropriately modified.

Figure 7:
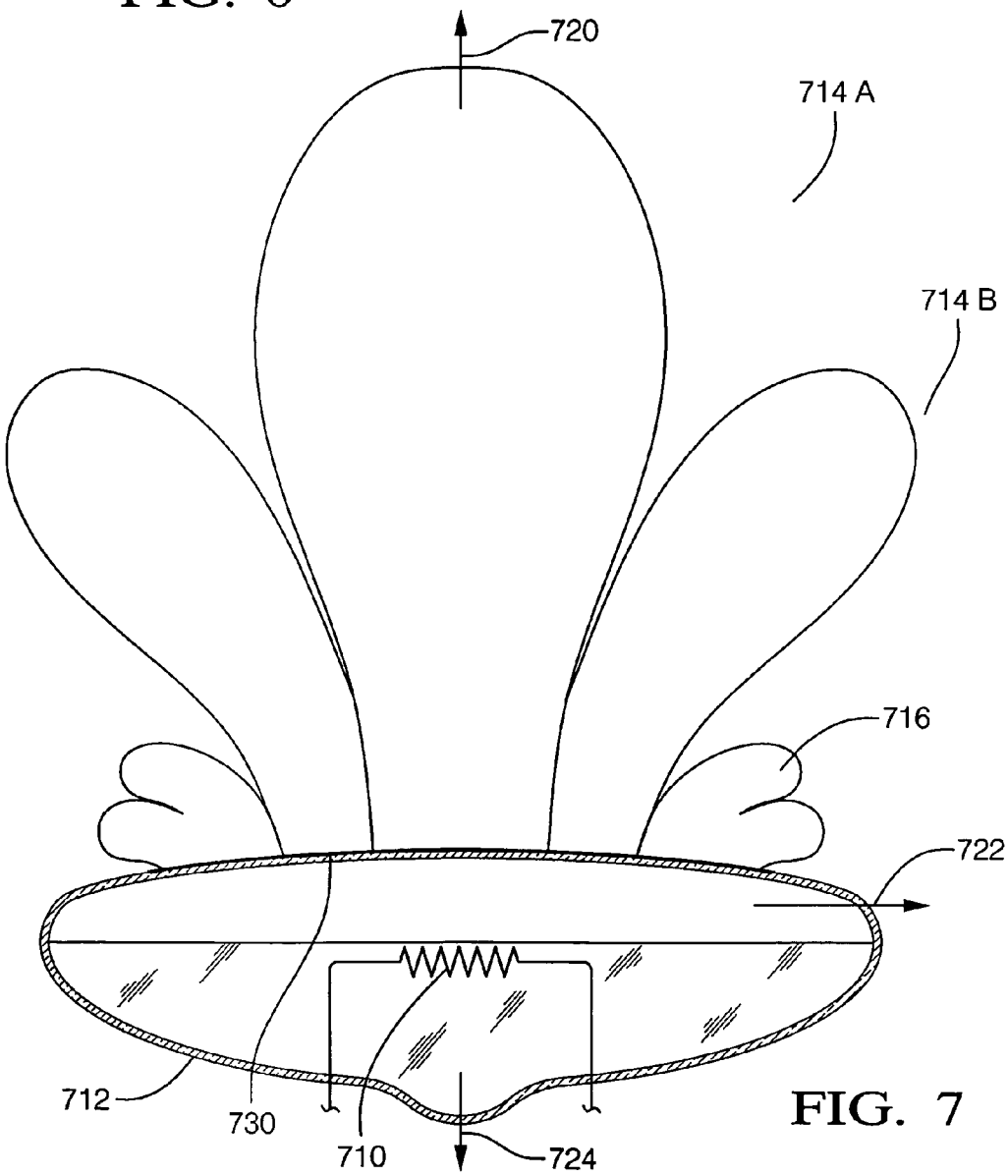
FIG. 7 is a two-dimensional side view of antenna pattern lobes being transmitted from a conductive material and reflective surface, in accordance with an embodiment of the present invention.

Referring to FIG. 7, an example two-dimensional view of antenna pattern lobes being transmitted from a conductive material 730 and reflective surface 712 is illustrated. The present invention utilizes such a directional pattern transmission to achieve improved/added gain radiated in a preferred direction over a signal radiated by an isotropic radiator. In an isotropic source, energy is radiated equally in all directions forming a sphere of radiation from the point source. By directing transmissions towards a receiver, the antenna of the present invention reduces any effects of interference. Further, since the antenna beam pattern lobes 714A and 714B extend outwardly in the general direction of the receiver (shown as direction 720, measured at 0 degrees), but are attenuated in most other directions (such as beam pattern lobes 716 in direction 722, measured at 90 degrees), less power is required. Moreover, reflective surface 712 redirects any beam patterns from direction 724 in a preferred direction such as direction 720 for added gain. In a further embodiment, conductive material 730 transmits a signal and filament 710 receives any incoming signal. In an alternative embodiment, filament 710 transmits a signal and conductive material 730 receives any incoming signal. Here, the conductive material 730 is utilized as a receiver. The details of employing filament 710 are discussed in U.S. patent application Ser. No. 11/987,786, entitled Directional Antenna, assigned to Delphi, and incorporated herein by reference.

Figure 8:
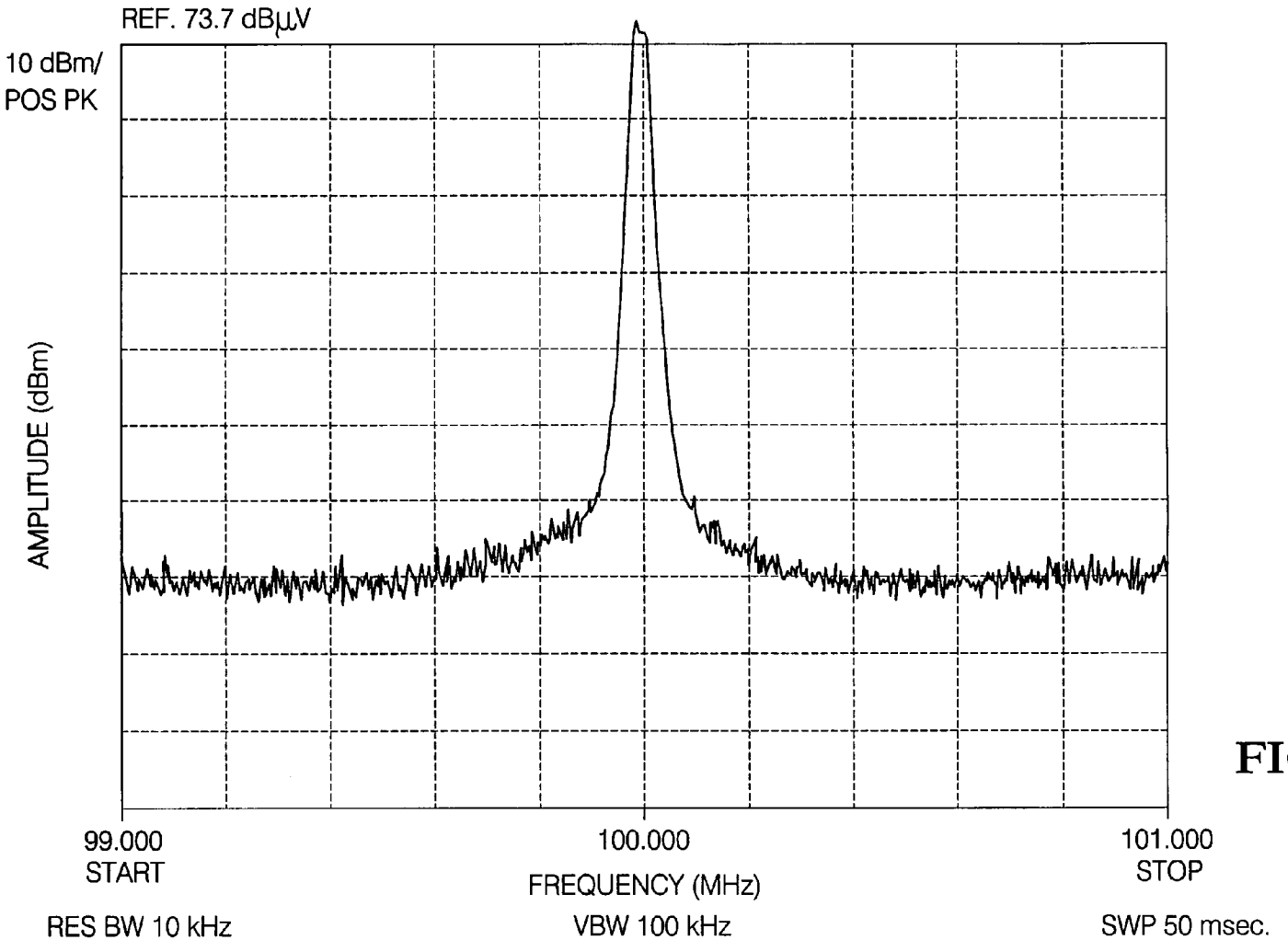
FIG. 8 is a graphical illustration showing the resulting signal amplitude of a useful frequency impressed across a conventional light filament, in accordance with an embodiment of the present invention.

A further understanding of the above description can be obtained by reference to the following experimental result examples that are provided for illustrative purposes and are not intended to be limiting. While the experimental results of FIG. 8 utilize a light filament as a transmitter, studies suggest that alternatively employing a conductive material formed to a transparent cover will show comparable results, with added freedom to select beam pattern, gain, polarization and wavelength for providing an effective resonant antenna. As illustrated in FIG. 8, a frequency can be impressed across a conventional light filament, and a useful signal amplitude produced. FIG. 6 demonstrates the signal amplitude (dBm) produced by 100 MHz impressed across a conventional vehicle headlight filament. The spectral display illustrates the received signal showing frequency (MHz) on the horizontal axis and amplitude (dBm) on the vertical axis. In an embodiment, for short range communication applications, 100 MHz is an optimum frequency impressed across a conventional vehicle headlight filament. At 100 MHz, the bandwidth of the RF signal narrows since the antenna system is approaching its resonant frequency. Further, the antenna system shows improved dBm (decibels relative to 1 mW) amplitude near the resonant frequency.

In an embodiment, signal generator 204 (FIG. 2), generates a signal having a bandwidth at a frequency in the range of about 1 megahertz (MHz) to at least 100 gigahertz (GHz) for broadcasting to a receiver or for detecting objects. Experimental results to date have shown the more useful transmitter frequencies, having acceptable gain, are in the range of 80 MHz to 600 MHz for a standard motor vehicle headlight. It is to be appreciated that other standard motor vehicle headlights may vary in useful transmitter frequencies. Further, in an embodiment the present invention can transmit a range of frequency bands including a LF (low frequency), MF (medium frequency), HF (high frequency), VHF (very high frequency), UHF (ultra-high frequency), and satellite broadcasting.

Other features and advantages of this invention will be apparent to a person of skill in the art who studies this disclosure. For example, it is to be appreciated that the conductive material formed to the transparent cover as discussed herein can both transmit and receive signals through atmospheric free space. Thus, exemplary embodiments, modifications and variations may be made to the disclosed embodiments while remaining within the spirit and scope of the invention as defined by the appended claims.

We claim:

1. A directional antenna system comprising:

an alternating current (AC) source;

a plurality of light beam reflective surfaces positioned to reflect through associated transparent materials, wherein the AC source provides AC via a transmission link to at least one of a plurality of conductive elements, wherein first and second light beam reflective surfaces of the plurality of light beam reflective surfaces are spaced apart from one another, and the conductive element associated with the reflective surface is formed to the associated transparent material, for creating an electromagnetic field about the conductive element and radiating electromagnetic radio waves, and wherein the first and second light beam reflective surfaces direct a portion of the electromagnetic radio waves in predetermined directions; and a processor that selectively provides AC from the AC source to the conductive element of each reflective surface, such that a phased array pattern of the electromagnetic field is formed.

2. The directional antenna system as in claim 1, wherein the conductive element comprises at least one of copper, silver, gold, aluminum, and indium tin oxide.

3. The directional antenna system as in claim 1, wherein the conductive element is formed in a predetermined length and shape including substantially T-shaped, a shape that alternates back and forth, straight, spiral, and rectangular, and wherein the conductive element is formed in a predetermined length.

4. The directional antenna system as in claim 1, wherein the transparent material having the conductive element is positioned a predetermined distance relative to the reflective material.

5. The directional antenna system as in claim 1, wherein the transparent material and the reflective surface are attached to one of a fixed structure and a mobile vehicle, wherein the fixed structure includes one of a building, fence and pole, and the mobile vehicle includes one of a car, truck, train, bicycle, airplane, and seagoing vessel.

6. The directional antenna system as in claim 1, further comprising a light filament enclosed by the transparent material and the reflective surface, wherein the conductive element and the light filament are incorporated into a vehicle light, wherein the vehicle light is one of a headlight, fog light and brake light.

7. The directional antenna system as in claim 1, wherein the AC source generates an RF signal having a bandwidth at a frequency in the range of 1 megahertz (MHz) to 100 gigahertz (GHz) for broadcasting to a receiver and for detecting objects.

8. The directional antenna system as in claim 7, wherein the RF signal has a bandwidth at a frequency in the range of 80 megahertz (MHz) to 600 megahertz (MHz).

9. The directional antenna system as in claim 1, further comprising a receiver, wherein the reflective surface receives radio frequency signals and transmits the radio frequency signals to the receiver.

10. The directional antenna system as in claim 1, further comprising an oscillator, the processor for instructing the AC source to generate a predetermined information signal and feed the information signal to a modulator, and for instructing the oscillator to generate a wave at a carrier frequency and feed the carrier frequency to the modulator, wherein the modulator superimposes the information signal onto the carrier frequency for transmission to the conductive element via the transmission link, wherein the information signal and carrier frequency are impressed across the conductive element.

11. A short range communication system comprising:

a plurality of light beam reflective surfaces positioned to reflect through associated transparent materials, wherein first and second light beam reflective surfaces of said plurality of light beam reflective surfaces are spaced apart from one another; and a plurality of conductive elements, wherein the conductive element associated with the reflective surface is formed to the associated transparent material, the conductive element for one of transmitting and receiving signals; and a processor that selectively provides alternating current (AC) from an AC source to the conductive element via a transmission link of each reflective surface, wherein:

when transmitting the alternating current, the AC source provides AC for creating an electromagnetic field about the conductive element and radiating electromagnetic radio waves, wherein the first and second light beam reflective surfaces direct a portion of the electromagnetic radio waves in predetermined directions, such that a phase array pattern of the electromagnetic field is formed; and when receiving, the conductive element directly receives the signals, and the reflective surface receives the signals and transmits the signals to the conductive element.

12. The short range communication system as in claim 11, wherein:

the conductive element comprises at least one of copper, silver, gold, aluminum, and indium tin oxide;

the conductive element is formed in a predetermined length and shape including substantially T-shaped, a shape that alternates back and forth, straight, spiral, and rectangular, and the conductive element is formed in a predetermined length; and the transparent material having the conductive element is positioned a predetermined distance relative to the reflective material.

13. The short range communication system as in claim 11, wherein the AC source generates an RF signal having a bandwidth at a frequency in the range of 1 megahertz (MHz) to 100 gigahertz (GHz).

14. The short range communication system as in claim 13, wherein the RF signal has a bandwidth at a frequency in the range of 80 megahertz (MHz) to 600 megahertz (MHz).

15. The short range communication system as in claim 11, further comprising a light filament enclosed by the transparent material and the reflective surface, wherein the conductive element and the light filament are incorporated into a vehicle light, wherein the vehicle light is one of a headlight, fog light and brake light.

16. A method of forming a light source into a directional antenna comprising:

establishing an alternating current (AC) source;

utilizing a plurality of light beam reflective surfaces positioned to reflect through associated transparent materials, wherein first and second light beam reflective surfaces of the plurality of light beam reflective surfaces are spaced apart from one another; and providing AC selectively, from the AC source to a plurality of conductive elements via a transmission link, wherein the AC is selectively provided to the conductive element associated with the reflective surface; and utilizing the AC source, wherein the conductive element is formed to the associated transparent material, for creating an electromagnetic field about the conductive element and radiating electromagnetic radio waves, wherein the first and second light beam reflective surfaces direct a portion of the electromagnetic radio waves in a predetermined directions, such that a phased array pattern of the electromagnetic field is formed.

17. The method as in claim 16, wherein the conductive element comprises at least one of copper, silver, gold, aluminum, and indium tin oxide.

18. The method as in claim 16, further comprising:

forming the conductive element in a predetermined length and shape including substantially T-shaped, a shape that alternates back and forth, straight, spiral, and rectangular; and forming the conductive element in a predetermined length.

19. The method as in claim 16, further comprising positioning the transparent material having the conductive element a predetermined distance relative to the reflective material.

20. The method as in claim 16, further comprising attaching the transparent material and the reflective surface to one of a fixed structure and a mobile vehicle, wherein the fixed structure includes one of a building, fence and pole, and the mobile vehicle includes one of a car, truck, train, bicycle, airplane, and seagoing vessel.

21. The method as in claim 16, further comprising employing a light filament enclosed by the transparent material and the reflective surface, wherein the conductive element and the light filament are incorporated into a vehicle light, and wherein the vehicle light is one of a headlight, fog light and brake light.

22. The method as in claim 16, further comprising generating an RF signal, utilizing the AC source, having a bandwidth at a frequency in the range of 1 megahertz (MHz) to 100 gigahertz (GHz), for broadcasting to a receiver and for detecting objects.

23. The method as in claim 22, wherein the RF signal has a bandwidth at a frequency in the range of 80 megahertz (MHz) to 600 megahertz (MHz).

24. The method as in claim 16, further comprising employing a receiver, wherein the reflective surface receives radio frequency signals and transmits the radio frequency signals to the receiver.

25. The method as in claim 16, further comprising an oscillator, the processor to instruct the AC source to generate a predetermined information signal and feed the information signal to a modulator, and to instruct the oscillator to generate a wave at a carrier frequency and feed the carrier frequency to the modulator, wherein the modulator superimposes the information signal onto the carrier frequency for transmission to the conductive element via the transmission link, wherein the information signal and carrier frequency are impressed across the conductive element.

* * * * *